United States Patent [19]

Harris et al.

[11] 4,253,841

[45] Mar. 3, 1981

[54] PROCESS FOR PHOTOINITIATED, POLYMERIC ENCAPSULATION OF COTTON FIBERS IN DURABLE-PRESS TEXTILES

[75] Inventors: James A. Harris, Pearl River; Jett C. Arthur, Jr., Metairie, both of La.

[73] Assignee: The United States of America as represented by the Secretary of Agriculture, Washington, D.C.

[21] Appl. No.: 14,406

[22] Filed: Feb. 23, 1979

[51] Int. Cl.[3] ..... D06M 15/36

[52] U.S. Cl. ..... 8/116 R; 8/115.6; 8/193; 8/194; 204/159.12; 260/17.4 GC

[58] Field of Search ..... 204/159, 12; 260/17.4 GC; 8/116 R, 193, 194, 115.6

[56] References Cited

U.S. PATENT DOCUMENTS

| | | | |
|---|---|---|---|
| 3,164,539 | 1/1965 | Smith | 204/159.12 |
| 3,256,166 | 6/1966 | Pfeiffer | 204/159.12 |
| 3,567,606 | 3/1971 | Das Gupta et al. | 204/159.12 |
| 3,645,869 | 2/1972 | Arthur | 8/116 R |
| 4,108,748 | 8/1978 | Portnoy et al. | 204/159.12 |
| 4,134,809 | 1/1979 | Pacifici et al. | 204/159.12 |
| 4,147,603 | 4/1979 | Pacifici et al. | 204/159.12 |

*Primary Examiner*—Wilbert J. Briggs, Sr.
*Attorney, Agent, or Firm*—M. Howard Silverstein; Raymond C. Von Bodungen; David G. McConnell

[57] ABSTRACT

A process for copolymerizing vinyl monomers with cotton to yield a product having encapsulated cotton fibers, the product in fabric form has improved durable-press properties, improved soil release, improved dyeability, improved abrasion resistance, and the product contains new multifunctional reactive groups which are useful in further textile modification. The reaction is carried out generally by treating cotton fabric with a vinyl monomer in a deoxygenated mixture of solvents, then irradiating the impregnated immersed fabric by exposure to near-ultraviolet-light radiation.

10 Claims, No Drawings

PROCESS FOR PHOTOINITIATED, POLYMERIC ENCAPSULATION OF COTTON FIBERS IN DURABLE-PRESS TEXTILES

BACKGROUND OF THE INVENTION (1) Field of the Invention

This invention relates to wet-processing of cotton textiles. More specifically, this invention relates to the processing of cotton textiles with vinylic monomers.

(2) Description of the Prior Art

Most processes for treating durable-press cotton textiles with polymeric finishes consist of padding solutions of polymers onto said textiles and then curing or drying the product at high temperatures in gas-fired ovens. This decreases the rate at which polymers are washed out of said textiles in normal usage. However, at the finishing plant, thermal pollution of both the air and wash-water effluents, chemical pollution of the atmosphere by thermal decomposition of the polymers during curing, heating, and drying, at high temperatures, of the treated textile products, chemical pollution of wash-water effluents that contain degraded polymeric fragments and solvents used in the solutions of polymers thereby leading to increased biochemical oxygen demand requirements of streams and rivers, and environmentally degrading effects occur. Further, a non-controllable, non-definitive, non-covalently linked reaction, in the sense of composite formation, occurs between the polymers and fibers of the said textiles.

There are increasing emphases on developing more sophisticated finishing processes for durable-press cotton textiles, so that known and controllable chemical reactions occur between finishing agents and cotton textiles. Development of these types of processes for cotton textiles will make said textiles more competitive in properties with man-made textiles where chemistry is known and controlled. In summary, the present state of the prior art in finishing durable-press cotton textiles, particularly in attempts to impart polymeric surface properties to said textiles, is in the realm of "art of finishing textiles" with little or no "science of finishing textiles."

Also, with increasing emphases on environmental protection and alternate sources and uses of energy, the prior art of textile finishing is based on thermal curing usually in high temperature ovens heated by natural gas which has predictably both short-term and long-term increases in cost and long-term decreases in supply. Further, the prior art leads to thermal pollution of the environment, both air and water. The prior art of textile finishing also uses catalytic agents that must subsequently be washed out of the textile product, leading to water and stream pollution and high usage of purified water, a critical and energy consuming resource in many regions. Thermal curing of textile finishing agents by the prior art leads to thermally initiated degradation of the finishing agents and to both air and water pollution. Further, unreacted textile finishing agents and degraded fragments of said agents must be washed out of the textile product leading to high water usage and pollution of streams. These environmental insults by textile finishing processes of the prior art are becoming less and less acceptable.

The state of this art is summarized by H. B. Goldstein in the article "Durable-Press Treatments" by G. L. Drake, Jr., and W. A. Reeves in the article "Flame-Resistant Textiles," in the book "Cellulose and Cellulose Derivatives," High Polymers, Vol. V, Part V, edited by N. M. Bilales and L. Segal, Wiley-Interscience, New York, 1971, pp. 1095–1113 and pp. 1293–1331, respectively.

Development of more sophisticated finishing processes for durable-press cotton textiles based on free-radical initiated chain reactions of chemical reagents with cellulose molecules comprising the textile fabrics could lead to a more scientifically-controlled finishing of textiles and improvement of their useful textile properties. The use of "free-radical curable" finishing agents on cotton, if the reactions were initiated by exposure of the fabrics and chemical reagents to high-energy radiation and ultra-violet light radiation, both non-polluting catalysts, could lead to a more efficient reaction of reagent with cotton, for example, 95 percent reaction for radiation processes as compared with about 70 percent reaction for thermally-initiated processes, with a minimum of environmental pollution in subsequent washing in the case for radiation processes. "Free-radical curable" chemical reagents must contain vinyl groups, so that chain reactions can be initiated. High-energy radiation interactions with cellulose comprising the fabric and the added chemical reagent are non-chemically specific and could lead to the formation of initiating free radicals on the cellulose molecules or the chemical agent. Processes for using high-energy radiation to initiate free-radical reactions of vinyl monomers have been summarized in an article entitled "Graft Polymerizations onto Polysaccharides" by Jett C. Arthur, Jr., published in *Advances in Macromolecular Chemistry,* Volume 2, pages 1 through 87, 1970.

The long-term interests in the effects of ultraviolet light radiation on cotton have been in improving the weather resistances of cotton products. Glyn O. Phillips and Jett C. Arthur, Jr., have reviewed the technical literature in this area in two review articles entitled "Chemical Effects of Light on Cotton Cellulose and Related Compounds. Part I. Primary Processes in Model Systems and Part II. Photodegradation of Cotton Cellulose" in the June and July 1969 issues of the Textile Research Journal, Volume 44, pages 497–505 and pages 572–580, respectively. It was subsequently determined that oxidative depolymerization reactions of cellulose were the predominant chemical reactions initiated on exposure of cotton to ultraviolet light radiation and that macrocellulosic free radicals were formed. The applicants' research group determined then to develop cotton textile finishing processes based on use of ultraviolet light radiation to initiate free-radical chain reactions with chemical finishing agents that contain vinyl groups, the presence of these groups being essential to maintain chain reactions. Jett C. Arthur, Jr., and Oscar Hinojosa reported on "Photopolymerization and Depolymerization in Glassy States and Fibrous Cotton Cellulose" in the Journal of Applied Polymer Symposia, No. 26, pages 147–156 (1975). Alden H. Reine, Jett C. Arthur, Jr., and Norman A. Portnoy were issued U.S. Pat. No. 3,926,555 on "Modification of Cotton Textiles and Cotton/Polyester Textile Blends by Photoinitiated Polymerization of Vinylic Monomers" which disclosed that graft polymerization of diacetone acrylamide, acrylamide, N,N-methylenebisacrylamide, N-vinyl pyrrolidone, acrylic acid, and methacrylamide on cotton/polyester textile blends improved the moisture regain and personal comfort properties of the cotton/-polyester textile blends.

SUMMARY OF THE INVENTION

In the present invention, cotton fabric is irradiated with near ultraviolet light while totally immersed in, and impregnated with, vinyl monomer solution. Unexpectedly, not only does the resultant copolymer distribute throughout the cross section of the cotton fibers, but the copolymers tend to concentrate in the surfaces of the fibers to yield encapsulation of the cotton fibers. In addition, free radical sites are formed essentially only on the cotton cellulose molecules thereby minimizing homopolymerization and ensuring covalent linkage of vinylic polymer to the cellulose molecules.

The polymeric grafted product possesses improved durable-press properties, dyeability, abrasion resistance, and the potential for further chemical reactivity by the addition of multifunctional groups.

In one embodiment of the present invention, a multilayered cotton fabric is immersed in a vinyl monomer solution, and only the top surface of the outermost layer is exposed to ultraviolet light. Despite the fact that the lower layers are not directly exposed to the light, graft copolymerization unexpectedly occurs through at least six layers of textile.

The main object of this invention is to provide a wet process for the unsensitized, photoinitiated copolymerization of vinylic monomers with cellulose in durable-press cotton textiles to yield polymeric encapsulated cotton fibers within said cotton textiles.

A second object of this invention is to provide a wet process for the unsensitized, photoinitiated copolymerization of vinylic monomers with cellulose in multilayered cotton textiles in which only the surface layer of said cotton textiles is exposed directly. to photoinitiating, copolymerizing, near-ultraviolet-light radiation to yield uniformly polymeric encapsulated cotton fibers within the several layers of said cotton textiles.

A third object of this invention is to provide a wet process for the unsensitized, photoinitiated copolymerization of vinylic monomers that contain carboxyl groups, reactive functional groups, and other groups with cotton textiles to yield polymeric encapsulated cotton fibers within said textiles that have improved durable-press, surface, and dyeability properties.

DESCRIPTION OF THE PREFERRED EMBODIMENTS

The vinyl monomers employed in the practice of the present invention preferably are selected from the group consisting of methyl methacrylate, glycidyl methacrylate, diacetone acrylamide, 1,3-butylene dimethacrylate, methacrylic acid, acrylonitrile, and divinyl benzene. Monomer stabilizers, which are well known in the art, such as benzoquinone or methylhydroquinone, may be present.

The light source generally should emit near-ultraviolet-light radiation with wavelengths ranging from about 254 to 350 nanometers (the power levels reflecting, respectively, 5 to 3 electron volts; or 112 to 81 kilocalories per mole, respectively.); and the light source generally is applied at power levels of about 21 to 35 watts for about 5 to 60 minutes. Within these ranges, the longer wavelengths and accompanying less energetic light are preferred because they result in minimum oxidative degradation of the cotton fibers, thereby yielding free-radical activated cotton textiles with minimum losses in textile properties such as breaking and tearing strengths.

Preferably, solutions of vinyl monomers are made with the maximum amount of water in the solvent (methanol-water), so that solutions of only one phase are obtained. Generally, the solutions contain about 1–15 volume percent monomer solute; and the solvent comprises about 0 to 49 volume percent water and about 51 to 100 volume percent methanol. When vinyl monomers are used that do not dissolve in methanol-water solvent, then N,N-dimethylformamide is added to methanol and to methanol-water solvents to prepare solutions of these vinyl monomers, so that only one phase is obtained. If N,N-dimethylformamide is employed, it is added in amounts of about 14 to 33 volume percent of the solvent. The use of water and methanol to prepare solutions of vinyl monomers to react subsequently with cotton cellulose makes use of the known state of the art on the selective differential swelling effects of methanol, water, and methanol-water solutions on the morphological structure and reactivity of cotton. For example, see the disclosure by Jett C. Arthur, Jr., Yoshio Nakamura, and Oscar Hinojosa in U.S. Pat. No. 3,989,454 of the effects of methanol, water, and methanol-water solvents in the process on the macromolecular modification of cotton and mercerized cotton by free-radical initiated chain reactions with solutions of vinyl monomers. The use of free radical reaction sensitizers such as benzophenone, diacetyl, or benzoin, are not necessary in the practice of the present invention.

The following examples illustrate laboratory-scale operation of the present invention.

EXAMPLES

Cotton textile fabric, a commercial grey printcloth (about 3.4 oz/sq yd, 84×77 thread count) was enzymatically desized, alkali scoured, and peroxide bleached. Samples of cotton fabrics (5 in.×10 in. and 3.5 in.×10 in.) were wrapped in 1 to 6 layers around pyrex cylindrical tubes so that only one side of the fabric is exposed to near-ultraviolet-light radiation. Then these fabric assemblies were immersed in quartz and pyrex containers of methanol, water, and N,N-dimethylformamide solutions that had been deoxygenated and contained vinyl monomers. After the desired irradiation time the samples of copolymerized fabrics were removed from the solutions and washed for about 20 min. in methyl ethyl ketone followed by washing with hot water, oven-dried at 105° C., air equilibrated, and weighed. The increase in weight of the copolymerized fabric over that of the untreated fabric used was reported as polymer add-on. Samples of cotton fibers were removed from the copolymerized fabrics and examined in the usual way by electron microscopy. In the tests below, examinations of electron micrographs of cross-sections of the copolymerized cotton fibers showed that polymer was formed throughout the cross-section of the cotton fibers; however, the concentration of polymer in the outer layers and surfaces of the cotton fibers was significantly greater than that in the inner layers of the fibers, so that an encapsulation of the cotton fibers had occurred. Further, when these cross-sections of copolymerized cotton fibers were contacted with 0.5 M cupriethylenediamine dihydroxide, the cellulose of the copolymerized cotton fibers did not dissolve. This indicated that strong bonding and covalent linkages existed between the cellulose of the cotton fibers and the copolymers.

Forty (40) samples prepared as above were tested in a number of ways, as shown in the following tables:

TABLE I

Effect of Wavelength and Type of Reactor on Photoinitiated Copolymerization of Glycidyl Methacrylate with Cotton Cellulose[a]

| Sample No. | Wavelength, mm. | Power, w. | Reaction time, min. | Polymer add-on, % Quartz reactor | Polymer add-on, % pyrex reactor |
|---|---|---|---|---|---|
| 1 | 254 | 35 | 30 | 22 | 18 |
| 2 | 300 | 21 | 30 | 61 | 53 |
| 3 | 350 | 24 | 30 | 32 | 32 |
| 4 | 350 | 24 | 60 | 69 | 72 |

[a]Temperature: 23–45° C.; solvent: methanol-57 vol.-% plus water-43 vol.-%; monomer concentration: 7.5 vol.-%; ratio of solution to cellulose: 50 ml./g.

As shown in Table I, the wave-length and power of the near-ultraviolet-light radiation and type of reactor effected the photoinitiated copolymerization of glycidyl methacrylate with cotton cellulose. Further examination of the copolymerized samples by electron microscopy showed that in all homopolymer formation, that is, formation of poly(glycidyl methacrylate) that was not covalently linked with the cotton cellulose comprising the cotton fibers was greatest when near-ultraviolet-light radiation of 300 nm. was used and that when near-ultraviolet-light radiation of 254 nm. was used, a greater amount of homopolymer was formed than when near-ultraviolet-light radiation of 350 nm. was used. Further, near-ultraviolet-light radiation of 350 nm. initiated less oxidative degradation of cotton fabric than near-ultraviolet-light radiation of 254 and 300 nm.; therefore, a higher percentage of the initial textile properties of the fabrics, such as breaking strength, was retained when near-ultraviolet-light radiation of 350 nm. was used. Considering all factors, near-ultraviolet-light radiation of 350 nm. gave the maximum yield of polymeric encapsulated cotton fibers with minimum of unreacted homopolymer formation and with maximum retention of initial textile properties of the cotton fabrics.

TABLE II

Effect of Monomer Stabilizer and Oxygen on Photoinitiated Copolymerization of Glycidyl Methacrylate with Cotton Cellulose [a]

| Experimental condition before reaction[b] | Polymer add-on, % Sample No. 5 | 6 | 7 | 8 | 9 | 10 | 11 |
|---|---|---|---|---|---|---|---|
| Monomer stabilizer removed | + | − | + | + | + | − | − |
| Solution purged with nitrogen | + | + | + | − | − | − | − |
| Vacuum (25 torr) applied to solution and released with nitrogen | + | + | − | + | − | + | − |
| | 32 | 27 | 21 | 15 | 8.0 | 3.6 | 2.4 |

[a]Temperature: 23–45° C.; irradiation: 350 nm., 30 min., 24 w; solvent: methanol-57 vol.-% plus water-43 vol.-%; monomer concentration: 7.5 vol.-%; ratio of solution to cellulose: 50 ml./g.
[b] + means experimental action taken; − means no action taken. The reference to Sample 5 for instance, indicates that the stabilizer was not present while it was present in Example 11.
[c]monomer stabilizer was removed as follows: monomer solutions were passed through an activated alumina column (80 to 200 mesh $Al_2O_3$) to remove any stabilizer or other added chemicals.

As shown in Table II, the removal of monomer stabilizer and oxygen was an important factor in the preferred practice of the present invention.

As shown in Sample No. 5, when monomer stabilizer was removed before reaction, the solution was purged with nitrogen to deoxygenate further before reaction and vacuum (25 torr) was applied to the solution and released with nitrogen to deoxygenate to a maximum extend before reaction, a maximum extent of copolymerization was obtained with 32% polymer add-on for the given near-ultraviolet-light radiation conditions. Further, as shown in Samples 5 through 11, if these experimental factors were selectively varied, % polymer add-on for the given near-ultraviolet-light radiation conditions ranged from 2.4 to 32% polymer add-on.

TABLE III

Effects of Monomer Concentration on Photoinitiated Copolymerization of Glycidyl Methacrylate with Cotton Cellulose[a]

| Sample No. | Monomer concentration, vol.-% | Polymer add-on, % |
|---|---|---|
| 12 | 1.0 | 4.2 |
| 13 | 1.5 | 6.6 |
| 14 | 3.0 | 18 |
| 15 | 5.0 | 27 |
| 16 | 7.2 | 40 |
| 17 | 15 | 70 |

[a]Temperature: 23–45° C.; irradiation: 350 nm., 34 min., 24 w.; solvent: methanol-57 vol.-% plus water-43 vol.-%; ratio of solution to cellulose: 50 ml/g.

As shown in Table III, the concentration of glycidyl methacrylate in solution was a factor, but not a critical factor, in the practice of the present invention.

TABLE IV

Effects of Solvent Composition on Photoinitiated Copolymerization of Glycidyl Methacrylate with Cotton Cellulose[a]

| Sample No. | Methanol, vol.-% | Water, vol.-% | Polymer add-on, % |
|---|---|---|---|
| 18 | 100 | 0 | 4.1 |
| 19 | 89 | 11 | 7.9 |
| 20 | 78 | 22 | 19 |
| 21 | 68 | 32 | 29 |
| 22 | 62 | 38 | 29 |
| 23 | 57 | 43 | 32 |
| 24 | 51 | 49 | 36 |

[a]Temperature: 23–45° C.; irradiation: 350 nm., 30 min 24 w.; monomer concentration: 7.5 vol.-% ratio of solution to cellulose: 50 ml./g.

As shown in Table IV, solvent composition was an important factor in the preferred practice of the present invention. Further, if water comprised about 50 vol.-% or greater of the solvent, the monomer tended to separate as a second phase thereby greatly decreasing polymer add-on.

TABLE V

Effects of Irradiation Time and Temperature on Photoinitiated Copolymerization of Glycidyl Methacrylate with Cotton Cellulose[a]

| Sample No. | Reaction time, min. | Polymer add-on, % Reaction temperature 23–45° C. | Polymer add-on, % Reaction temperature 45° C. |
|---|---|---|---|
| 25 | 5 | 3.1 | 5.0 |
| 26 | 10 | 6.4 | 12 |
| 27 | 20 | 20 | 30 |
| 28 | 30 | 32 | 45 |
| 29 | 45 | — | 74 |
| 30 | 60 | 69 | — |

[a] Irradiation: 350 nm.; 24 w.; solvent: methanol-57 vol.-% plus water-43 vol.-% monomer concentrations: 7.5 vol.-%; ratio of solution to cellulose: 50 ml./g.

As shown in Table V, irradiation time and temperature were factors in the practice of the present invention.

TABLE VI

Effect of Multilayered Fabrics on Photoinitiated Copolymerization of Glycidyl Methacrylate with Cotton Cellulose[a]

| Fabric layer[b] No. | Polymer add-on, % Sample No. 31 (Total number of layers of fabric 1[c]) | 32 (3[d]) | 33 (6[e]) |
|---|---|---|---|
| 1 | 32 | 30 | 29 |
| 2 | — | 27 | 25 |
| 3 | — | 25 | 22 |
| 4 | — | — | 20 |
| 5 | — | — | 14 |
| 6 | — | — | 11 |

[a]temperature: 23–45° C.; irradiation: 350 nm., 34 min., 24 w.; solvent: methanol-57 vol.-% plus water-43 vol.-%; monomer concentration: 7.3 vol.-%.
[b]Only external fabric layer no. 1 irradiated directly by near-ultraviolet light.
[c]Ratio of solution to cellulose = 50 ml./g.
[d]Ratio of solution to cellulose = 17 ml./g.
[e]Ratio of solution to cellulose = 8 ml./g.

As shown in Table VI, the total number of multilayered cotton fabrics, when only external fabric layer number 1 was irradiated directly under the given near-ultraviolet-light radiation conditions, was a factor in the practice of the present invention; however, although when total volume being irradiated was kept constant, the solution/cellulose ratio ranged from 8 to 50 ml of solution per g of cellulose dependent on the number of layers of fabric and polymer add-on from fabric layer number 1 to fabric layer number 6 ranged from 32 to 11% add-on.

TABLE VII

Comparison of Photoinitiated Copolymerization of Selected Monomers with Cotton Cellulose[a]

| Sample No. | Monomer[b] | Solvent systems: water vol. % | methanol vol.-% | DMF,[c] vol.-% | Monomer Concentration, vol.-% | Reaction time, min. | Polymer add-on, % |
|---|---|---|---|---|---|---|---|
| 34 | MMA | 47 | 53 | — | 7.5 | 30 | 38 |
| 35 | GMA | 43 | 57 | — | 7.5 | 30 | 32 |
| 36 | DAA | 50 | 50 | — | 7.5 | 30 | 21 |
| 37 | BDMA | 33 | 67 | — | 7.5 | 60 | 18 |
| 38 | MAA | 50 | 50 | — | 15 | 30 | 9.2 |
| 39 | AN | 78 | 8 | 14 | 7.5 | 60 | 5.8 |
| 40 | DVB | — | 67 | 33 | 14 | 60 | 0.8 |

[a]Temperature: 23–45° C.; irradiation: 350 nm., N,N-dimethylformamide. w.; ratio of solution to cellulose: 50 ml./g.
[b]Code: MMA, methyl methacrylate; GMA, glycidyl methacrylate; DAA, diacetone acrylamide; BDMA, 1,3-dibutylene dimethacrylate; MAA, methacrylic acid; AN, acrylonitrile; DVB, divinyl benzene.
[c]DMF, N,N-dimethylformamide.

As shown in Table VII, methyl methacrylate, glycidyl methacrylate, diacetone acrylamide, 1,3-butylene dimethacrylate, methacrylic acid, acrylonitrile, and divinyl benzene in solutions of water, methanol, and N,N-dimethylformamide could be copolymerized with cotton cellulose by irradiation with near-ultraviolet-light radiation to yield textile products with 0.8 to 38% polymer add-on under the conditions used.

We claim:

1. A process for photoinitiated polymeric encapsulation of cotton fibers in durable press textiles comprising: irradiating cotton fabrics with near ultraviolet light while totally immersed in, and impregnated with, a vinyl monomer solution.

2. The process of claim 1 wherein said vinyl monomer is selected from the group consisting of methyl methacrylate, glycidyl methacrylate, diacetone acrylamide, 1,3-butylene dimethacrylate, methacrylic acid, acrylonitrile, and divinyl benzene.

3. The process of claim 1 wherein said fabric is immersed in said solution in multiple layers, and wherein said light is directed only at the top surface of the outermost layer.

4. The process of claim 2 wherein said solution comprises about 1–15 volume percent vinyl monomer, and wherein the solvent for said solution comprises about 51 to 100 volume percent methanol and about 0 to 49 volume percent water.

5. The process of claim 3 wherein said vinyl monomer is selected from the group consisting of methyl methacrylate, glycidyl methacrylate, diacetone acrylamide, 1,3-butylene dimethacrylate, methacrylic acid, acrylonitrile, and divinyl bezene.

6. The process of claim 4 wherein the temperature of the monomeric solution is about from 23° to 45° C., and wherein the near-ultraviolet irradiation is applied for about from 5 to 60 minutes at power levels of about 21 to 35 watts and of from wavelengths of about 254 to 350 nanometers, reflecting, respectively, about from 5 to 3 electron volts of energy.

7. The process of claim 5 wherein said solution comprises about 1–15 volume percent vinyl monomer and wherein the solvent for said solution comprises about 51 to 100 volume percent methanol and about 0 to 49 volume percent water.

8. The process of claim 5 wherein the temperature of the monomeric solution is about from 23° to 45° C., and wherein the near-ultraviolet light irradiation is applied for about from 5 to 60 minutes at power levels of about 21 to 35 watts and of from wavelengths of about 254 to 350 nanometers, reflecting, respectively, about from 5 to 3 electron volts of energy.

9. The fabric produced by the process of claim 6.

10. The fabric produced by the process of claim 8.

* * * * *